US006589346B2

(12) United States Patent
Schick et al.

(10) Patent No.: US 6,589,346 B2
(45) Date of Patent: Jul. 8, 2003

(54) PIPE COATING APPARATUS AND METHOD

(75) Inventors: Calvin Schick, Edmonton (CA); Randall Henry Danderfer, Ardrossan (CA)

(73) Assignee: Bredero-Shaw Company, Halifax (CA)

( * ) Notice: Subject to any disclaimer, the term of this patent is extended or adjusted under 35 U.S.C. 154(b) by 0 days.

(21) Appl. No.: 09/907,816

(22) Filed: Jul. 19, 2001

(65) Prior Publication Data

US 2003/0017275 A1 Jan. 23, 2003

(51) Int. Cl.[7] ..... B05B 5/14

(52) U.S. Cl. ..... 118/631; 118/634; 118/630; 118/629; 118/64; 118/309; 118/316

(58) Field of Search ..... 118/631, 634, 118/629, 630, 64, 313, 314, 315, 316, 309

(56) References Cited

U.S. PATENT DOCUMENTS

| | | | | |
|---|---|---|---|---|
| 1,576,327 A | | 3/1926 | Hughes | |
| 1,821,352 A | | 9/1931 | McManis | |
| 1,948,843 A | | 2/1934 | Dallas | |
| 1,957,791 A | | 5/1934 | McManis | |
| 2,050,036 A | | 8/1936 | Boax et al. | |
| 2,597,021 A | | 5/1952 | Norris | |
| 2,777,784 A | | 1/1957 | Miller | |
| 2,781,279 A | | 2/1957 | Miller | |
| 2,781,280 A | | 2/1957 | Miller | |
| 3,453,134 A | * | 7/1969 | Haw | 427/473 |
| 3,603,287 A | * | 9/1971 | Christy et al. | 118/309 |
| 3,847,353 A | | 11/1974 | Wynne, II | |
| 4,038,942 A | | 8/1977 | Hart | |
| 4,333,783 A | | 6/1982 | Gardner | |
| 4,371,295 A | | 2/1983 | Hart | |
| 4,510,007 A | | 4/1985 | Stucke | |
| 4,595,607 A | | 6/1986 | Betteridge et al. | |
| 4,816,296 A | | 3/1989 | Gibson | |
| 4,877,645 A | | 10/1989 | Bleich et al. | |
| 5,026,451 A | | 6/1991 | Trzecieski et al. | |
| 5,178,902 A | | 1/1993 | Wong et al. | |
| 5,186,755 A | | 2/1993 | Carlson, Jr. et al. | |
| 5,417,786 A | | 5/1995 | Denman et al. | |
| 6,410,093 B2 | * | 6/2002 | Ohira et al. | 427/356 |

FOREIGN PATENT DOCUMENTS

| | | |
|---|---|---|
| GB | 2 285 592 | 7/1995 |

* cited by examiner

*Primary Examiner*—Richard Crispino
*Assistant Examiner*—George R. Koch, III
(74) *Attorney, Agent, or Firm*—Clark & Brody

(57) ABSTRACT

An apparatus for and method of coating the outer surface of a non-rotating pipe with a fluid including a fluid reservoir for containing fluid to be discharged onto the surface of a pipe, and a pipe receiving chamber extending through and separate from the fluid reservoir. The apparatus further includes a fluid application assembly having a plurality of fluid intake openings positioned in the fluid reservoir for the intake of fluid therefrom. The fluid intake openings are rotatable in a circular pattern within the reservoir about a path extending through the chamber. The assembly has a plurality of fluid discharge outlets in fluid communication with the fluid intake openings and directed towards the path. The fluid discharge outlets are rotatable in unison with the fluid intake openings about the path, whereby fluid entering the fluid intake openings from the reservoir is discharged through the fluid discharge outlets to coat the outer surface of a pipe being conveyed along the path.

16 Claims, 7 Drawing Sheets

PIPE COATING APPARATUS AND METHOD

FIELD OF THE INVENTION

The present invention relates to pipe coating apparatus and methods for coating a length of non-rotating pipe with a fluid.

BACKGROUND OF THE INVENTION

Steel pipes or tubing which are intended for underground installation must be protectively coated against corrosion. This is typically accomplished by coating a pipe with an adhesive coating or primer followed by a layer of plastic jacketing material in a two-step procedure. The primer frequently consists of a particulate epoxy thermo-setting powder which fuses to a heated pipe to which the powder is applied. The jacketing material often consists of high density polyethylene.

A traditional method for protectively coating a length of pipe is to rotate and convey a heated pipe longitudinally through a booth in which are mounted an array of powder guns. The powder guns spray particulate primer material about the circumference of the pipe as it is advanced through the booth. Downstream of the booth is spiral wrapping apparatus which winds jacketing material in screw thread fashion onto the rotating pipe as disclosed, for example, in U.S. Pat. No. 3,616,006 to Landgraf et al.

There are several disadvantages associated with the above approach. First, the conveying system used to rotate and advance the pipe is expensive to construct and maintain. Second, particularly in connection with smaller diameter pipes, it is difficult to achieve a uniform coating of primer on the pipe and there is also a great deal of over-spray and hence wastage of primer material. Third, jacketing material applied using a spiral method are subject to weak joints at the overlap and poor coverage of radial or longitudinal welding seams on the pipe. The disadvantages of spiral wrapping are greater where high density polyethylene is applied as the outer jacketing material. Pipe which has been spiral-wrapped with jacketing material often exhibits relatively poor low temperature adhesion of the protective coating. Fourth, this approach can only be used in an industrial plant setting and cannot be used to renew the pipe coating of a pipe at the site of installation.

To overcome the above disadvantages, alternative methods for protectively coating pipe have been sought. For example, a presently preferred method of jacketing a pipe employs a "cross-head" extrusion technique, also known as a "straight-through" or "endo" process. This entails conveying a non-rotating pipe longitudinally through an annular nozzle or head of an extruder, the extruder being operable to extrude tubular coatings of adhesive film and jacketing material over the pipe as it passes through the extrusion head.

To more readily employ the cross-head extrusion technique, it is desirable to provide an apparatus for and method of coating a length of non-rotating pipe with primer material upstream of the cross-head extruder. Furthermore, it is desirable that such apparatus be adapted to overcome or minimize the other problems described above.

SUMMARY OF THE INVENTION

Accordingly, in accordance with one aspect, the invention provides an apparatus for coating the outer surface of a non-rotating pipe with a fluid. The apparatus includes a fluid reservoir for containing fluid to be discharged onto the surface of a pipe, and a pipe receiving chamber extending through and separate from the fluid reservoir. The apparatus further includes a fluid application assembly having a plurality of fluid intake openings positioned in the fluid reservoir for the intake of fluid therefrom. The fluid intake openings are rotatable in a circular pattern within the reservoir about a path extending through the chamber. The assembly has a plurality of fluid discharge outlets in fluid communication with the fluid intake openings and directed towards the path. The fluid discharge outlets are rotatable in unison with the fluid intake openings about the path, whereby fluid entering the fluid intake openings from the reservoir is discharged through the fluid discharge outlets to coat the outer surface of a pipe being conveyed along the path.

In accordance with another aspect, the invention provides a method of applying a fluid coating to a length of non-rotating pipe employing the apparatus.

BRIEF DESCRIPTION OF THE DRAWINGS

To facilitate a better understanding of the invention, an apparatus and method according to a preferred embodiment thereof will now be described with reference to the drawings in which.

DESCRIPTION OF THE PREFERRED EMBODIMENT

Figure 1:
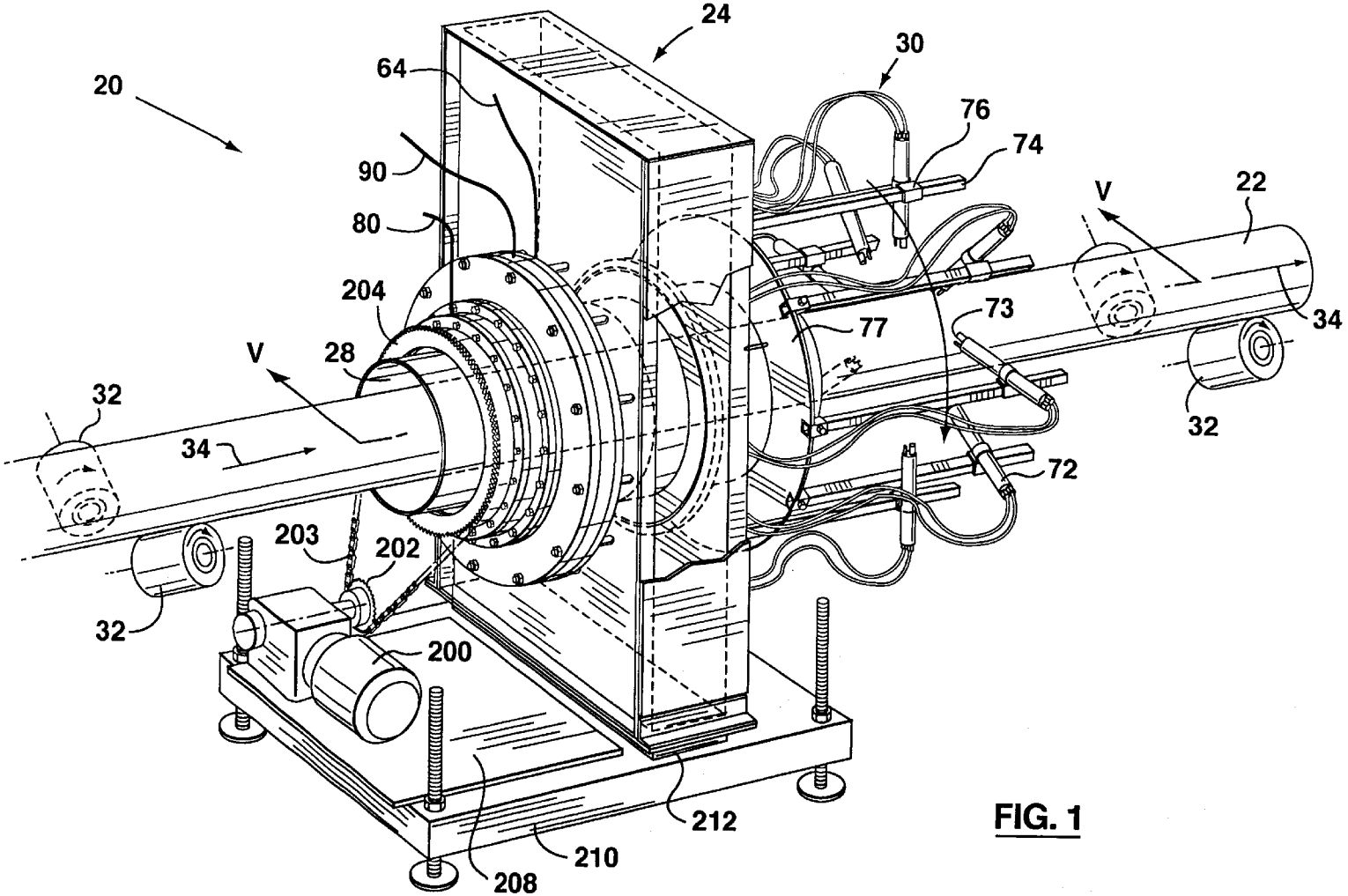
FIG. 1 is an isometric partial view of the apparatus in use coating the outer surface of a length of non-rotating pipe.
Figure 5:
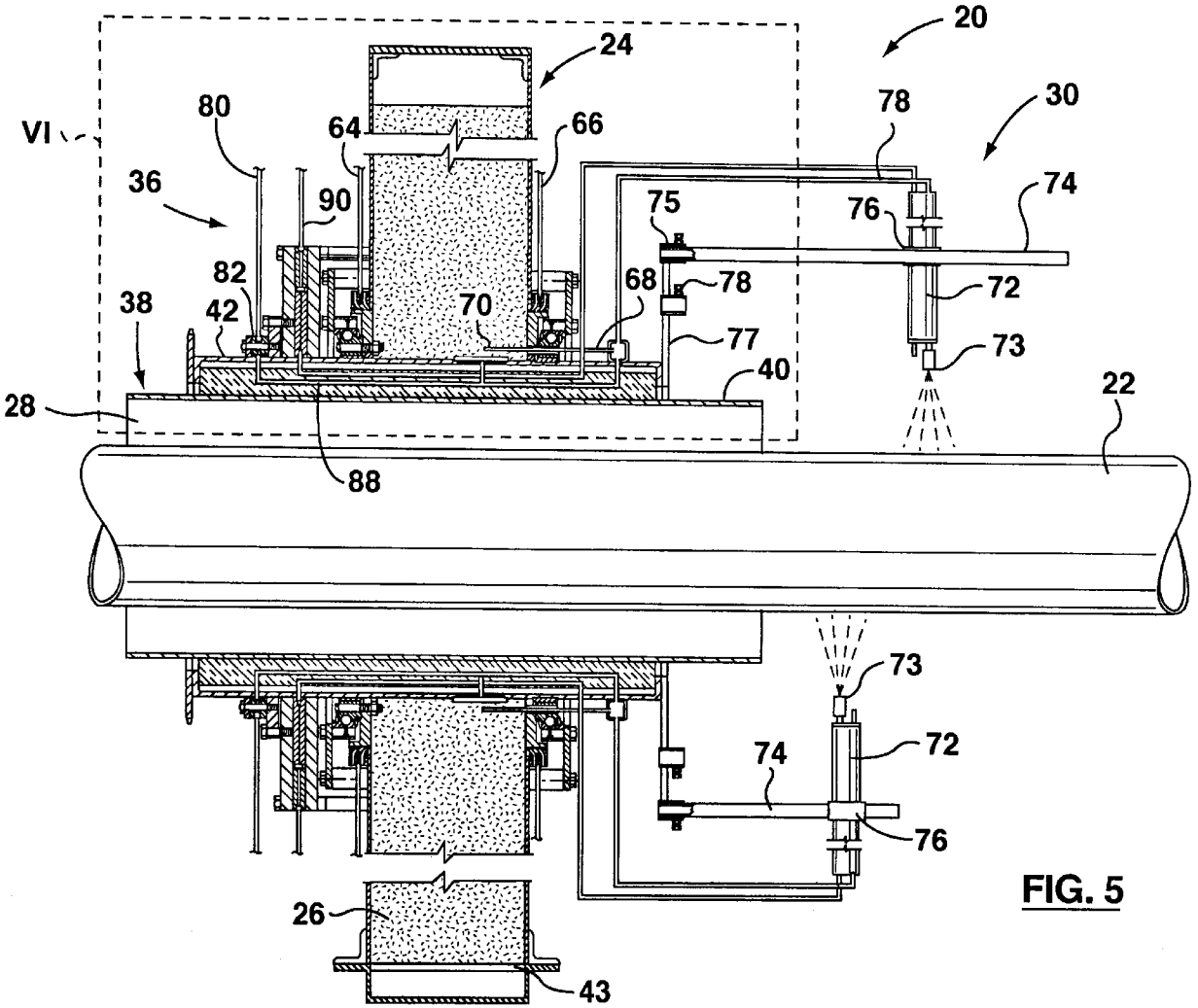
FIG. 5 is a partial side sectional view of the apparatus taken along line V—V of FIG. 1.
Figure 6:
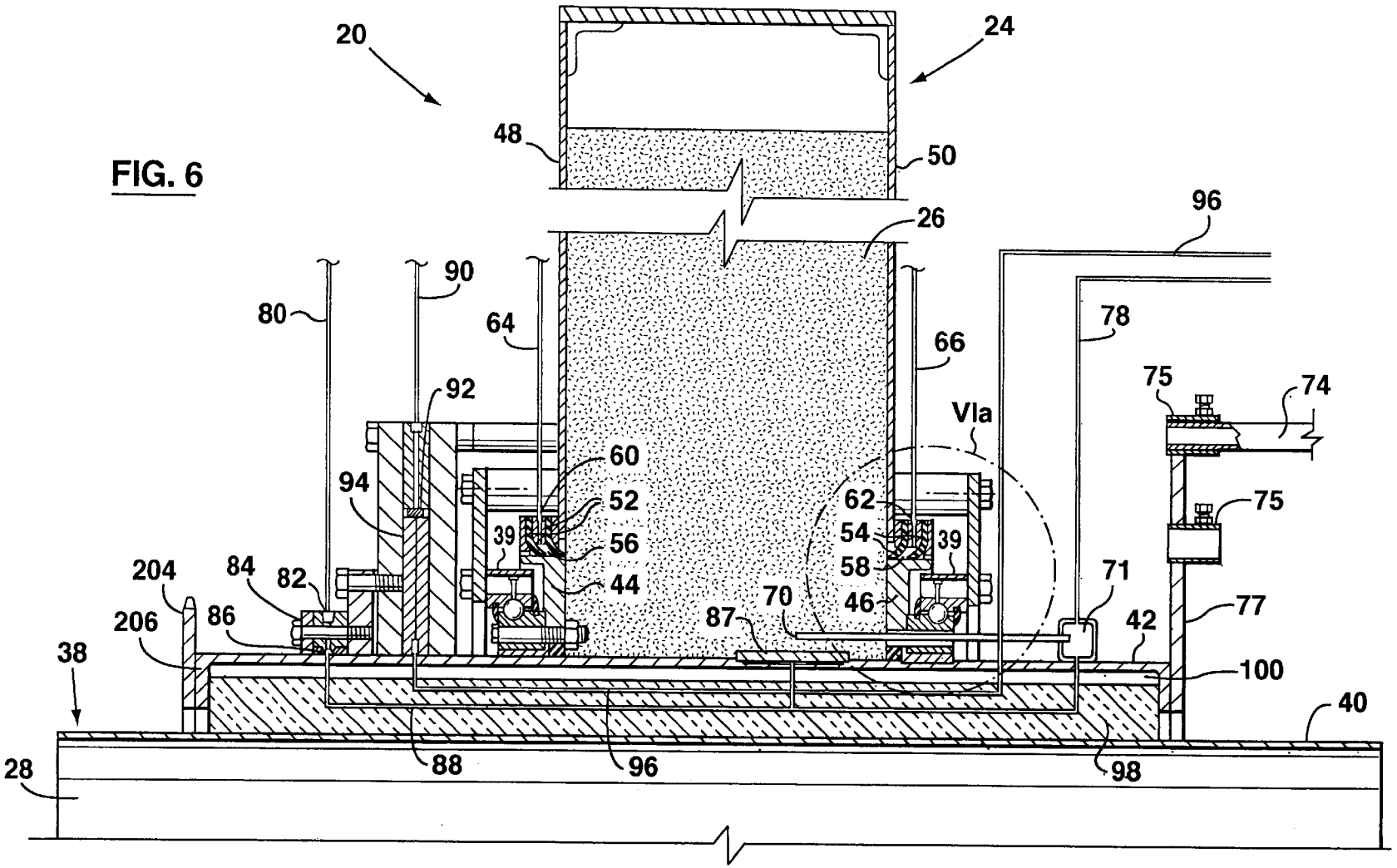
FIG. 6 is an enlarged view of a portion of FIG. 5 identified by numeral VI in FIG. 5.

Referring primarily to FIG. 1, an apparatus 20 for coating the outer surface of a non-rotating steel pipe 22 with fluid is shown in part. The apparatus 20 includes a fluid reservoir 24 formed by a rectangular housing which contains aerated fluid to be discharged. This fluid is shown in FIGS. 5 and 6 and consists of a particulate epoxy thermo-setting powder designated by numeral 26. A cylindrical chamber 28, for receiving the pipe 22 therethrough, extends horizontally through and is separate from the fluid reservoir 24, as will be further described. The apparatus 20 also includes a fluid application assembly designated generally by reference numeral 30 which rotates about the pipe 22 and is adapted to electrostatically coat the outer surface thereof with the particulates 26. In use, a conventional pipe conveyor system, of which only driven rollers 32 thereof are shown, conveys the pipe 22 longitudinally in a non-rotating manner through the chamber 28. The pipe 22 is conveyed along a path 34 co-extensive with a longitudinal axis thereof while the fluid application assembly 30 rotates continuously about the path 34 and sprays particulates onto the surface of portions of the pipe 22 exiting the chamber 28.

Figure 6A:
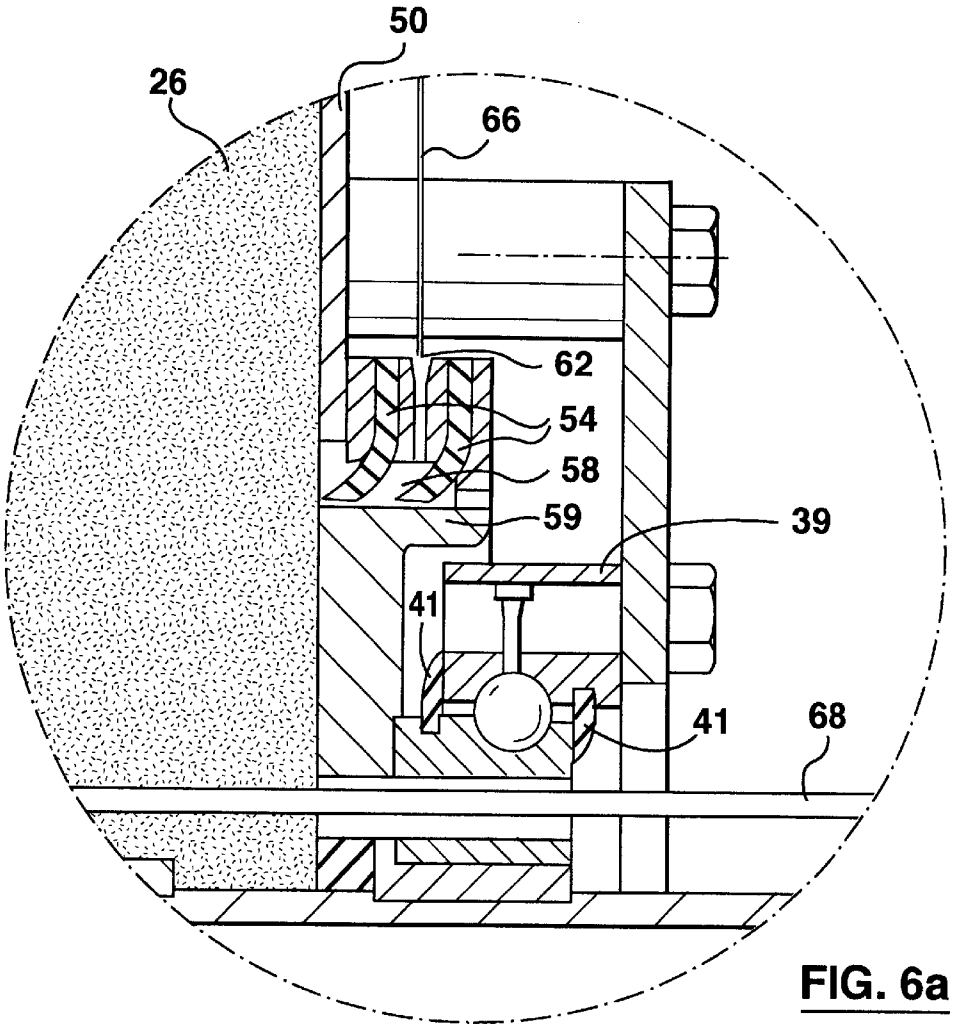
FIG. 6*a* is an enlarged view of the portion designated VIa in FIG. 6.
Figure 7:
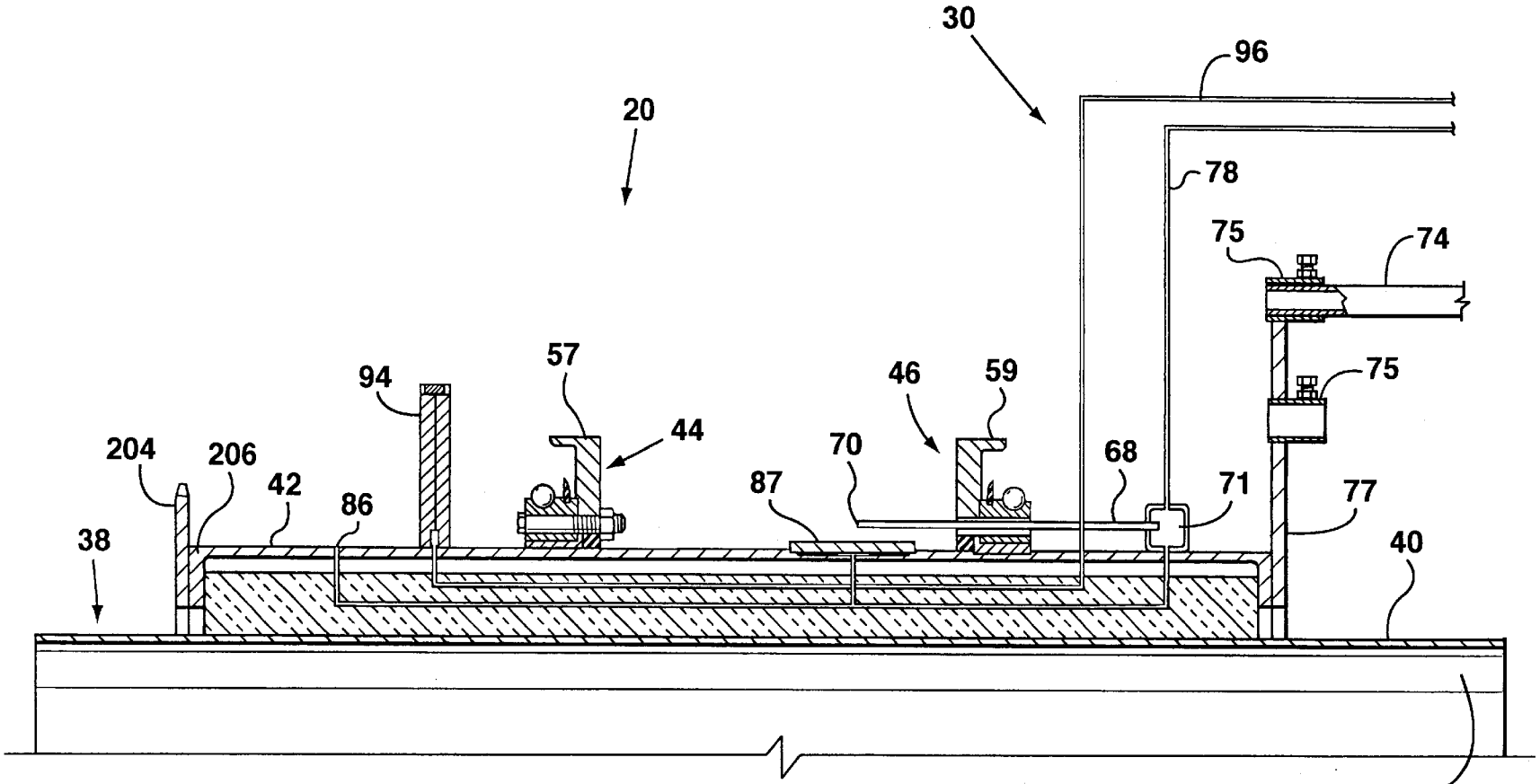
FIG. 7 is a partial side sectional view similar to the view of FIG. 6 and showing rotating components of the apparatus.

Referring now to FIGS. 5 to 7, the apparatus 20 includes a stationary structure 36 and a rotating structure consisting of the fluid application assembly 30, which is partially shown and best seen in FIG. 7. The fluid application assembly 30 includes a steel drum 38 supported by customized annular bearings 39 located one on each side of the fluid reservoir 24 and forming part of the stationary structure 36. An enlarged sectional view of one bearing 39 which is similar to the other bearing 39 is shown in FIG. 6*a*. As seen in FIG. 6*a*, a pair of gum rubber annular seals 41 are attached, one to the rotating structure and one to the bearing 39 to further prevent the leakage of particulates from the fluid reservoir 24, as will be discussed further below. The steel drum 38 is continuously rotatable about the path 34 in the bearings 39.

Particulates 26 in the fluid reservoir 24 are aerated primarily by a first fluidizing membrane 43 located near the bottom of the fluid reservoir and shown schematically in FIG. 5. Air conduits (not shown) supply pressurized air to the first fluidizing membrane for discharge into the fluid reservoir as is known in the art.

The drum 38 has a cylindrical inner and outer walls 40, 42 defined about the path 34. The inner wall 40 defines the chamber 28 and the outer wall 42 defines an inner wall of the fluid reservoir 24. As can be best seen with reference to FIG. 7, the rotating structure includes annular rotating wall structures 44, 46 welded to and extending radially outwardly from the outer wall 42 of the drum 38 for rotation therewith. These wall structures 44, 46 form part of the fluid reservoir 24. As best seen with reference to FIG. 6, the fluid reservoir 24 further has first and second spaced stationary walls 48, 50 which are in fluid-tight sealing engagement with respective said rotating wall structures 44, 46. The stationary walls 48, 50 form part of the stationary structure 36 of the apparatus 20. To prevent particulates 26 from leaking from the reservoir 24 where the stationary walls 48, 50 meet the rotating wall structures 44, 46, the apparatus 20 is provided with a pair of spaced apart, inwardly extending resilient gum rubber gaskets 52, 54 mounted to an inner extent of each stationary wall 48, 50 for sealing contact with an outer extent of a respective said rotating wall structure 44, 46. The gaskets 52, 54 are each sandwiched between steel retaining rings which are welded together and to an outer surface of a radially inward portion of the stationary walls 48, 50. The gaskets 52, 54 sealingly engage an outer cylindrical surface of sealing rings 57, 59 which are integrally formed with the annular wall structures 44,46, respectively. To further prevent leakage during rotation of the drum 38, pressurized air is supplied to annular spaces 56, 58 located between each pair of annular gaskets 52, 54 by stationary air supply lines 64, 66. These air supply lines 64, 66 each have one end (not shown) connected to a source of pressurized air and an opposite end directed to the respective annular space 56, 58 to supply pressurized air thereto. Rubber seals 41 associated with the customized bearings 39 function as a supplementary barrier against fluid leakage.

Figure 4:
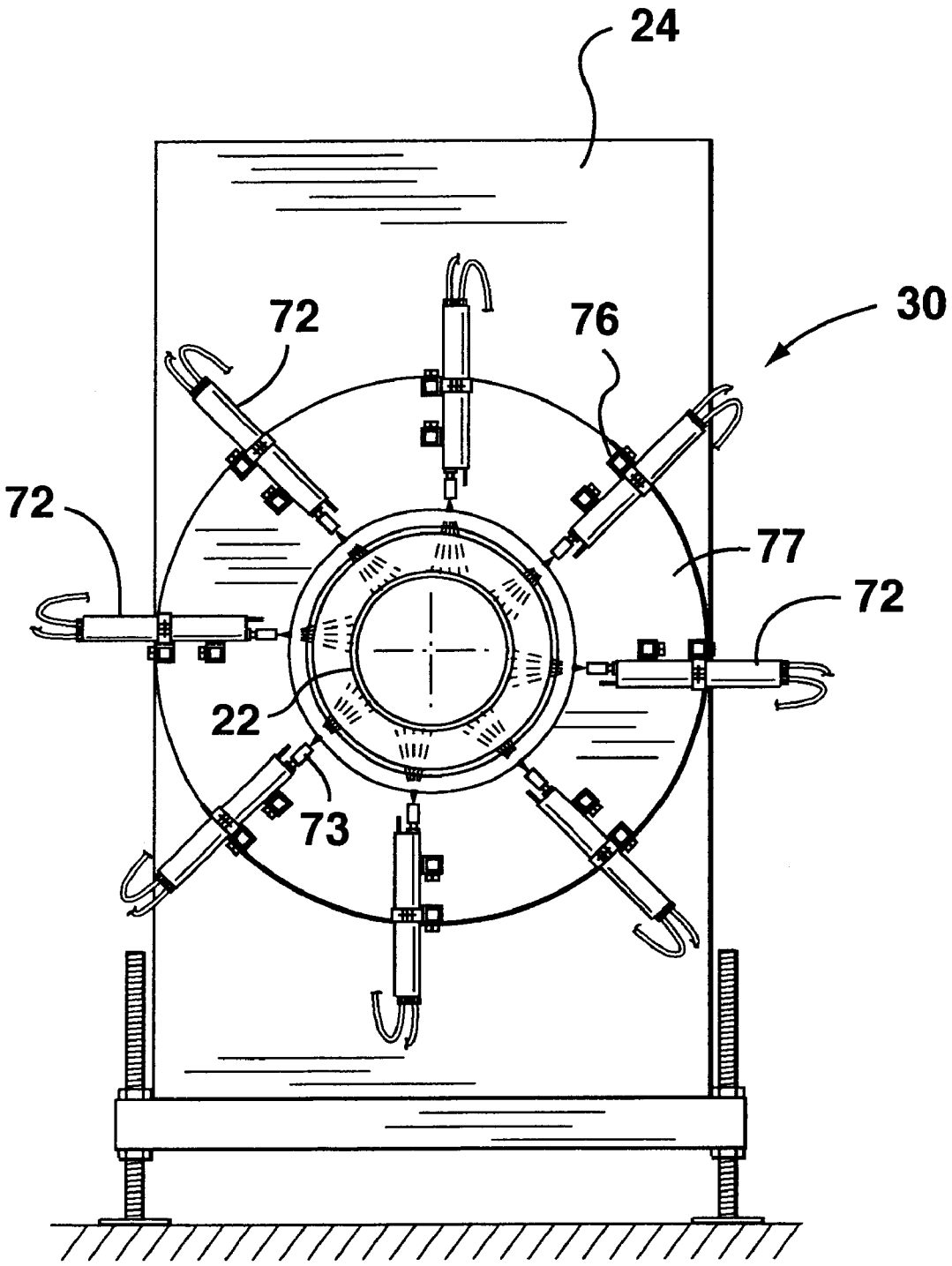
FIG. 4 is a partial rear view of the apparatus.

The apparatus 20 picks up particulates 26 pneumatically from the fluid reservoir 24 using fluid intake members in the form of eight equidistantly angularly spaced pneumatic intake wands 68. Each wand 68 is rigidly mounted in the second annular rotating wall structure 46 and has a fluid intake opening 70 at one end disposed in the fluid reservoir 24 for rotation in a circular pattern within the reservoir 24. At an opposite end of each wand 68 is an air outlet positioned in a venturi 71 of which there are also eight. The venturi 71 are equidistantly circumferentially spaced about and attached to the outer wall 42 of the drum 38. The fluid application assembly 30 also includes eight equidistantly spaced discharge guns 72 having respective eight discharge outlets 73 directed towards the path 34 and in fluid communication with respective corresponding intake wands 68 by way of the venturi 71 (see also FIG. 4). The discharge guns 72 are mounted to axially extending support members 74 by brackets 76. The support members 74 are rigidly bolted to a mounting ring 77 of the rotating structure and the discharge guns 72 and intake wands 68 are thus mounted to rotate in unison about the path 34.

The fluid application assembly 30 has a stationary air supply line 80 having one end (not shown) connected to a source of pressurized air and an opposite end terminating at an air discharge outlet 82 which communicates with an air conduit structure 84. The air conduit structure 84 is configured to convey air from the air supply line 80 to an annular air inlet 86 provided in and extending circumferentially about the cylindrical outer wall 42 of the drum 38. Pressurized air from the annular air inlet 86 is channelled to the venturi 71 and a second fluidizing membrane 87 via eight angularly spaced axially-extending conduits in the form of copper tubes 88. The second fluidizing membrane 87 is in the form of a plastic sheet with holes or perforations sized, spaced and numbered to produce a uniform bed of air for further aerating the particulates in the fluid reservoir 24 and to prevent settlement of the particulates on the top portion of the drum 38. A pressure differential between the interior of the fluid reservoir 24 and the interior of the venturi 71 causes particulates to enter the intake openings 70 of the intake wands 68 and flow to the venturi where the particulates are entrained in flowing pressurized air and carried to the discharge guns 72 through the flexible air hoses 78. The discharge guns 72 include conventional particulate charging means for imparting a positive electric charge on the particulates 26 prior to their discharge from the guns 72.

In order to impart this positive electrical charge, the apparatus includes a stationary electrical conduit 90 having one end (not shown) connected to a voltage supply and an opposite end coupled to a brushing electrical contact 92. The apparatus 20 further has an annular electrical contact member in the form of a commutator ring 94 extending radially-outwardly from and rotatable with the drum 38. Eight angularly-spaced electrical conduits (ie. wires) carry electrical current from the commutator ring to respective charging means on the discharge guns 72. The wires are encased in standard Teflon™ tubes 96 which insulate and protect the wires from damage. The commutator ring 94 is in constant electrical contact with the brushing electrical contact 92 whereby electricity may be supplied to the discharge guns 72 during rotation of the drum 38.

Positively charged discharged particulates are electrostatically attracted to the pipe 22 which is maintained at ground by conventional grounding means (not shown) forming part of the pipe conveyor system. The conveyor system also includes conventional means for heating the pipe 22 using induction coils (not shown). The coils are effective in heating the pipe 22 to temperatures between 200° C. and 250° C. such that discharged particulates 26 may fuse with and bond to the pipe 22.

To prevent the particulates 26 inside the fluid reservoir 24 from melting or fusing together due the heat discharged by the pipe 22, the drum 38 is provided with insulating material 98 consisting of ceramic wool and an air gap 100 between the inner and outer walls 40, 42. Although ceramic wool is used, any other suitable insulating material, such as fibreglass wool, may also be used. As can be seen with reference to FIG. 6, for example, the air and electrical conduits 88,96 extend partially through the insulating material 98 where they are also protected from the heat of the pipe 22.

Figure 3:
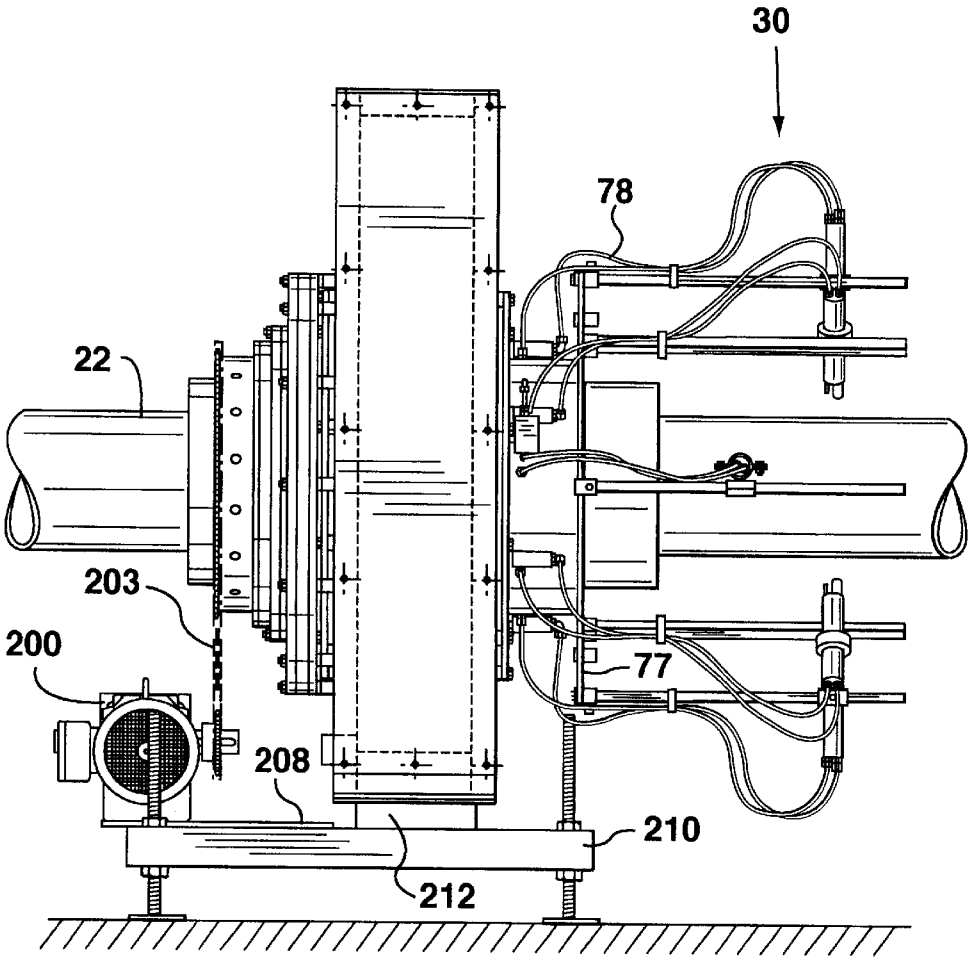
FIG. 3 is a partial side view of the apparatus.
Figure 2:
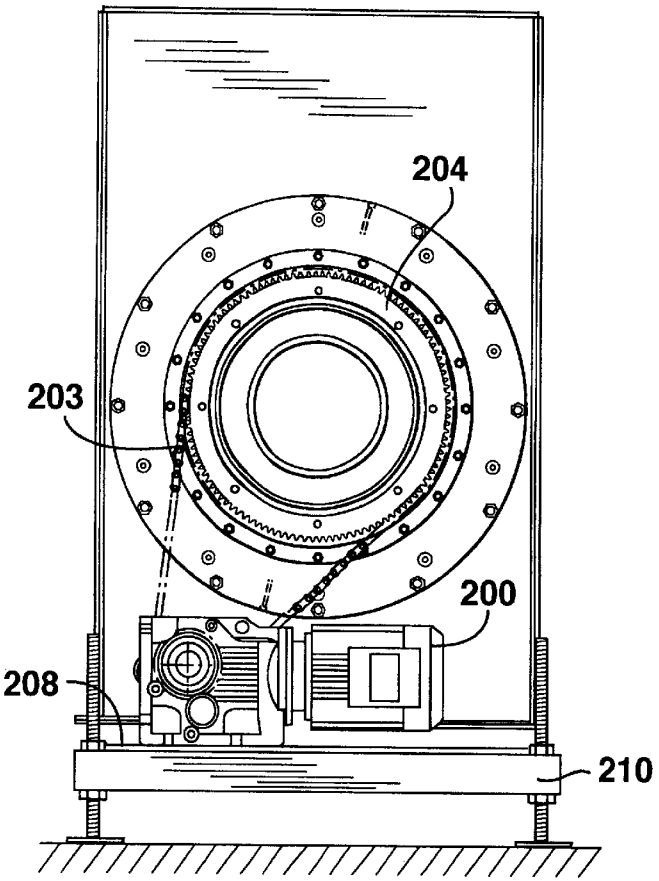
FIG. 2 is a partial front view of the apparatus.

The mechanism for rotating the fluid application assembly will now be described with reference mainly to FIGS. 1 to 3 which show a conventional motor 200 having a drive wheel 202 coupled by a chain 203 to a driven sprocket wheel 204. The sprocket wheel 204 is welded to an annular flange 206 extending inwardly from the outer cylindrical wall 42 of the drum 38 (see FIG. 6). Rotating the drive wheel 202 operates to rotate the sprocket wheel 204 to thereby rotate the fluid application assembly 30.

The entire apparatus 20 is secured in place by bolting the motor 200 to a mounting plate 208 which is in turn welded to an upper surface of a support platform 210. The fluid reservoir 24 is secured in a similar manner by welding the bottom of the housing to a second mounting plate 212 which is in turn welded to the support platform 210. The platform 210 is, in turn, bolted to the floor to provide a fixed base.

The invention thus provides a method of applying a particulate coating to a length of non-rotating pipe 22 which includes the following steps:

(a) providing a fluid reservoir 24 containing fluid which may be in the form of particulates 26 to be discharged onto the surface of the pipe 22;

(b) providing a pipe receiving chamber 28 extending through and separate from the fluid reservoir 24;

(c) providing a fluid application assembly 30 having a plurality of fluid intake openings 70 positioned in the fluid reservoir 24 for the intake of particulates 26 therefrom, the intake openings 70 being rotatable in a circular path within the reservoir 24, the assembly 30 also having a plurality of fluid discharge outlets 73 in fluid communication with the fluid intake openings 70, said fluid discharge outlets 73 being directed radially inwardly and rotatable in unison with the fluid intake openings 70;

(d) conveying a length of pipe 22 through the chamber 28; and (e) operating the fluid application assembly 30 to continuously rotate the fluid intake openings 70 and fluid discharge outlets 73 about the pipe 22 and to take in particulates 26 through the intake openings 70 and discharge the particulates 26 through the discharge outlets 73 to coat the outer surface of the pipe 22.

The apparatus and method of the present invention have several advantages. For example, the apparatus makes use of pipe conveying systems which are much easier and cheaper to construct and maintain. Also, the fluid application assembly 30 is capable of achieving a more uniform coating of primer with less wastage. Furthermore, the present apparatus may be used together with the preferred downstream cross-head extrusion process which requires lengths of non-rotating pipe.

Variations to the preferred embodiment of the apparatus 20 are contemplated. For example, the number of intake wands 68 and discharge guns 72 may vary within practical limits readily determinable by those skilled in the art, depending on factors such as the diameter of the pipe 22 to be coated, the speed with which the pipe 22 is conveyed through the chamber 28, the speed of rotation of the fluid application assembly 30, and the rate of discharge of the particulates 26 from the discharge guns 72. These factors are also variable within certain ranges which may be readily determined by simple experimentation.

It will be appreciated that the foregoing description is by way of example only and shall not be construed so as to limit the scope of the invention as defined by the following claims.

We claim:

1. An apparatus for coating an outer surface of a non-rotating pipe with a fluid comprising:

a fluid reservoir for containing fluid to be discharged onto the outer surface of a pipe;

a pipe receiving chamber extending through and separate from the fluid reservoir; and a fluid application assembly having a plurality of fluid intake openings positioned in said fluid reservoir for an intake of fluid therefrom, said intake openings being rotatable in a circular pattern within said reservoir about a path extending through said pipe receiving chamber, the fluid application assembly having a plurality of fluid discharge outlets in fluid communication with said fluid intake openings and directed towards said path, said fluid discharge outlets being rotatable in unison with said fluid intake openings about said path;

whereby fluid entering said fluid intake openings from the fluid reservoir is discharged through said fluid discharge outlets to coat the outer surface of a pipe being conveyed along said path.

2. An apparatus according to claim 1 wherein said fluid is in the form of powdered particulates and said fluid application assembly operates pneumatically to take in particulates through said fluid intake openings and to discharge particulates through said fluid discharge outlets.

3. An apparatus according to claim 1 wherein said fluid application assembly comprises a drum having cylindrical inner and outer walls defined about an axis coextensive with said path, said inner wall defining said pipe receiving chamber and said outer wall defining an inner wall of said fluid reservoir, said drum being rotatable about said axis, and said fluid intake openings and fluid discharge outlets being rigidly coupled to said drum for rotation therewith.

4. An apparatus according to claim 3 wherein said drum is insulated to protect the fluid reservoir against heat discharged by a heated pipe being conveyed along said path.

5. An apparatus according to claim 3 wherein said fluid reservoir has first and second spaced annular rotating walls rigidly attached to and extending radially outwardly from the outer wall of said drum for rotation therewith, the fluid reservoir further having first and second spaced stationary walls in fluid-tight sealing engagement with respective said rotating walls to prevent fluid leakage from the reservoir.

6. An apparatus according to claim 5 comprising a pair of spaced apart, inwardly extending resilient annular gaskets mounted to an inner extent of each stationary wall for sealing contact with an outer extent of said first and second spaced annular rotating walls respectively, said annular gaskets defining an annular space therebetween, the apparatus comprising an air supply line for supplying pressurized air to said annular space to keep fluid within the reservoir.

7. An apparatus according to claim 5 wherein said fluid application assembly comprises a plurality of fluid intake members each provided with a respective one of said fluid intake openings, said fluid intake members being mounted in said second annular rotating wall.

8. An apparatus according to claim 3 wherein the fluid application assembly comprises a stationary air supply line having one end connected to a source of pressurized air and an opposite end coupled to an air discharge outlet, and an annular air inlet provided in and extending circumferentially about said cylindrical outer wall, the annular air inlet being in fluid communication with said air discharge outlet and said fluid discharge outlets whereby pressurized air can be supplied to the fluid discharge outlets during rotation of the drum.

9. An apparatus according to claim 3 comprising a ipie conveyor system operable to convey a pipe through said pipe receiving chamber along said path in a non-rotating manner.

10. An apparatus according to claim 9 for coating the outer surface of a non-rotating pipe electrostatically, wherein said pipe conveyor system is adapted to ground a pipe being conveyed thereby, said apparatus comprising a stationary electrical conduit connected to a voltage supply at one end and coupled to a brushing electrical contact at an opposite end, and an annular electrical contact member extending radially outwardly from the drum and in constant electrical contact with said brushing electrical contact, said annular electrical contact member being coupled electrically to the fluid discharge outlets whereby particulates discharged thereby are charged and attracted electrostatically to the pipe.

11. An apparatus according to claim 3 comprising a plurality of rigid support arms mounted to and extending away from said drum, and a plurality of discharge guns carried by respective said support arms, each discharge gun being provided with a respective one of said fluid discharge outlets.

12. An apparatus according to claim 1 wherein the number of fluid intake openings is equal to the number of fluid discharge outlets.

13. An apparatus according to claim 1 wherein the fluid intake openings are equidistantly angularly spaced and the fluid discharge outlets are equidistantly angularly spaced.

14. An apparatus according to claim 1 wherein said fluid discharge outlets are located outside of said pipe receiving chamber to coat sections of pipe exiting said pipe receiving chamber.

15. An apparatus for electrostatically coating the outer surface of a non-rotating pipe with powdered particulate comprising:

a powdered particulate reservoir for containing powdered particulates to be discharged onto the surface of a grounded pipe;

a pipe receiving chamber extending through and separate from the reservoir; and a powder application and charging assembly having a plurality of powder intake openings positioned in said reservoir for the intake of powdered particulates therefrom, said powder intake openings being rotatable about a path extending through said pipe receiving chamber in a circular pattern within said reservoir, said powder application and charging assembly having a plurality of discharge guns in communication with said powder intake openings, each discharge gun being adapted to impart an electrical charge on particulates entering the gun and having a powder discharge outlet directed towards said path for discharging charged particulates onto a grounded pipe being conveyed along said path, said powder discharge outlets being rotatable in unison with said powder intake openings about said path to coat the entire outer circumference of the pipe.

16. An apparatus according to claim 15 comprising a pipe conveyor or system operable to ground and convey the pipe through said pipe receiving chamber along said path.

* * * * *